US005494205A

United States Patent [19]

Nielsen et al.

[11] Patent Number: 5,494,205

[45] Date of Patent: Feb. 27, 1996

[54] APPARATUS FOR FESTOONING A TRAVELING LENGTH OF WEB-LIKE MATERIAL

[75] Inventors: Arne Nielsen, Oakridge; Majid Moghaddassi; Mark R. Keenan, both of Greensboro, all of N.C.

[73] Assignee: Guilford Mills, Inc., Greensboro, N.C.

[21] Appl. No.: 208,607

[22] Filed: Mar. 9, 1994

[51] Int. Cl.[6] ..... B65H 20/32

[52] U.S. Cl. ..... 226/104; 226/118; 226/14; 242/417.2

[58] Field of Search ..... 226/104, 105, 226/107, 118, 14; 242/417.2

[56] References Cited

U.S. PATENT DOCUMENTS

| | | | |
|---|---|---|---|
| 1,540,722 | 6/1925 | Colbert et al. . | |
| 1,582,457 | 4/1926 | Ford . | |
| 1,919,747 | 7/1933 | Richardson . | |
| 3,826,417 | 7/1974 | Koster et al. | 226/107 |
| 4,560,099 | 12/1985 | Arioli et al. | 226/105 |

*Primary Examiner*—John M. Jillions
*Assistant Examiner*—Thomas E. Dunn
*Attorney, Agent, or Firm*—Shefte, Pinckney & Sawyer

[57] ABSTRACT

Apparatus for festooning a traveling length of textile fabric or other web-like material comprises a frame supporting a pair of opposed spaced endless conveyor chains across which a plurality of fabric support rods are removably carried by the conveyor chains in succession with one another for supporting an individual festoon of the fabric depending between each successively adjacent pair of the rods. A secondary conveyor arrangement at the fabric entrance end of the frame is operative to temporarily remove each succeeding fabric support rod from the conveyor chains and, after a selected dwell time, to replace each removed rod onto the conveyor chains to control the festooning accumulation of the fabric on the support rods. The upper web carrying run of the conveyor chains extends upwardly and downwardly in a sinuous path of travel over a succession of angularly inclined chain guide flanges, by which the overall length of the web carrying run in relation to the horizontal lengthwise dimension of the festooning apparatus is maximized.

13 Claims, 5 Drawing Sheets

APPARATUS FOR FESTOONING A TRAVELING LENGTH OF WEB-LIKE MATERIAL

BACKGROUND OF THE INVENTION

The present invention relates generally to apparatus for accumulating a traveling length of web-like material, such as textile fabric, and relates more particularly to apparatus of such type which operates to form the accumulated material in succeeding festoons.

Apparatus of the aforementioned type are commonly employed in various industries to temporarily accumulate a traveling length of web-like material during a predetermined interruption in the downstream travel of the material so that the upstream delivery of the material can continue uninterrupted so that the production efficiency or capacity of the particular manufacturing operation can be optimized. For example, it is common in various textile fabric-producing and fabric-treating operations to wind the fabric into roll form as the fabric completes the operation. When it is periodically necessary to doff the wound roll of fabric upon reaching its maximum capacity, it is highly desirable not to interrupt the fabric-producing or fabric-treating operation which is delivering the fabric to the roll. Accordingly, it is common practice to position a fabric accumulating apparatus or device between the roll-winding location and the upstream fabric-producing or fabric-treating operation to receive the continuing delivery of fabric while the doffing operation is carried out and until the winding of a new fabric roll can be initiated.

The foregoing web accumulating procedure has functioned suitably in practice for some time. However, as the production speeds of conventional textile fabric-producing and fabric-treating equipment has increased in recent years, the limited capacity of conventional fabric accumulating apparatus has begun to effectively limit the full realization of the maximum production capacity of modern textile equipment. For example, one conventional form of fabric accumulating device still in use in the textile industry is a so-called "horse" which basically comprises an elongate saddle over which a traveling fabric may be laid back and forth in a plaited manner. The disadvantage of utilizing a "horse" for accumulating fabric is that, as the fabric accumulates, the increasing weight of the fabric is borne by the initially-laid plaits of fabric, and thus the total capacity of a "horse" is limited, particularly with fabrics such as plush or pile fabrics whose surface may be sensitive to crushing forces.

One conventionally-available alternative is festooning-type fabric accumulating apparatus wherein a series of uniformly spaced festoon support bars are affixed to an endless conveyor arrangement which is selectively driven to allow fabric to be accumulated in successive festoons depending between the succeeding support bars. However, this type of apparatus also has inherent limitations as to the maximum capacity for accumulating fabric without increasing the size of the festooning apparatus, either vertically or horizontally.

Given the capacity limitations of conventional "horses" and festoon-type accumulators, the normal time periods required for performing a typical fabric roll-doffing operation, and the relatively high production capacities of many conventional textile fabric producing machines, it can occur when the fabric-producing or fabric-treating machine is operating at its full capacity that a conventional "horse" or festoon accumulator will approach or even reach its full capacity within the amount of time required to accomplish a doffing operation, leaving little or no margin for error or delay in the doffing operation.

SUMMARY OF THE INVENTION

It is accordingly an object of the present invention to provide an improved festoon-type accumulating apparatus particularly suitable for use in textile fabric handling operations, which is adapted to accumulate a substantially greater capacity of festooned fabric (or other web-like material) than conventional festooning accumulators essentially without any significant overall increase in the dimensional size of the present apparatus over conventional festoon accumulators.

Briefly summarized, the festooning apparatus of the present invention basically comprises a frame on which is supported a conveyor arrangement for movement in an endless path of travel which includes a web carrying run extending generally laterally across the frame between a web receiving location and a web releasing location, with a suitable motor or the like being provided for selectively driving traveling movement of the conveyor arrangement. A plurality of web support elements are removably carried by the conveyor arrangement in succession with one another for supporting an individual festoon of the web depending between each successively adjacent pair of the support elements. According to the present invention, a means is arranged generally at the web receiving location for temporarily removing each succeeding web support element from the conveyor arrangement and then replacing each removed element onto the conveyor arrangement, which enables the festooning accumulation of the web on the support elements to be selectively controlled.

According to another aspect of the present invention, the web carrying run of the conveyor arrangement moves in a sinuous path of travel to increase the length of the web carrying run in relation to the lateral dimension between the web receiving and web releasing locations. For example, in the preferred embodiment, the web carry run comprises a plurality of conveyor path segments extending angularly to one another in succession upwardly and downwardly. The conveyor arrangement may also be provided with appropriate means for adjustably varying the angular relation of the conveyor path segments to one another.

Preferably, the conveyor arrangement is formed of a pair of endless conveyor chains correspondingly arranged in spaced parallel relation at opposite sides of the frame to travel synchronously with one another about respective sets of guide sprockets. Each chain carries a series of longitudinally spaced pins which receive the web support elements therebetween. Stationary retainers are disposed on the frame along selected portions of the travel path of the conveyor arrangement for maintaining the web support elements between the pins of the chains.

The preferred means utilized for removing and replacing the web support elements on the conveyor arrangement utilizes a secondary conveyor arranged at the web receiving location for receiving the web support elements from the conveyor arrangement at an element releasing position and transporting the elements to a replacement position along the conveyor arrangement in a predetermined timed relation to the traveling movement of the conveyor arrangement for causing a festoon of a predetermined length of the traveling web to form between succeeding web support elements. The secondary conveyor preferably is provided with an element guide device extending between the element releasing and replacement positions and an associated endless conveyor belt having at least one transfer pin for periodically engaging and transporting the web support elements in sequence through the guide device.

DETAILED DESCRIPTION OF THE PREFERRED EMBODIMENT

Figure 1:
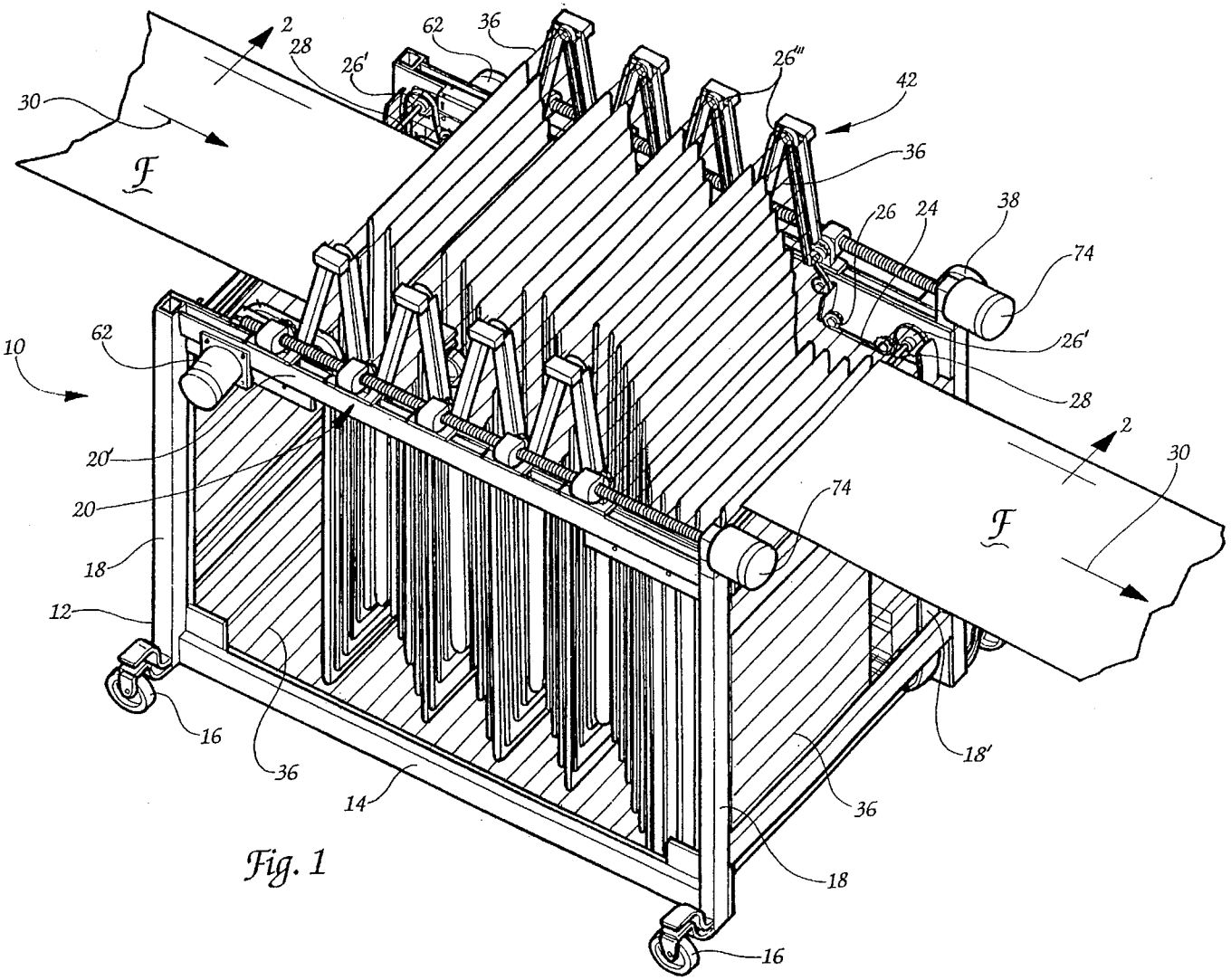
FIG. 1 is a top perspective view of a textile fabric festooning apparatus according to the preferred embodiment of the present invention.
Figure 2:
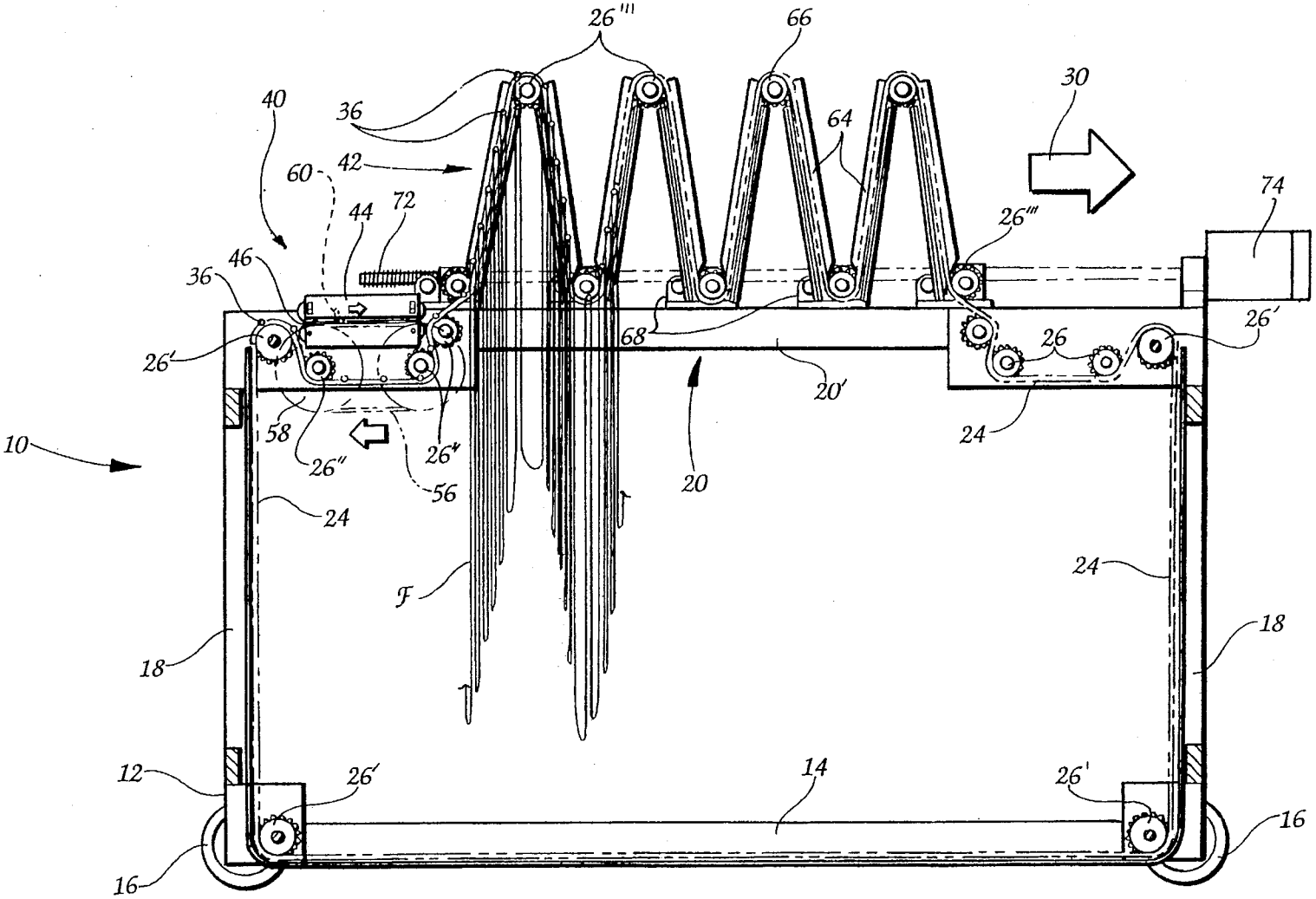
FIG. 2 is a vertical cross-sectional view of the festooning apparatus of FIG. 1, taken along line 2—2 thereof.
Figure 3:
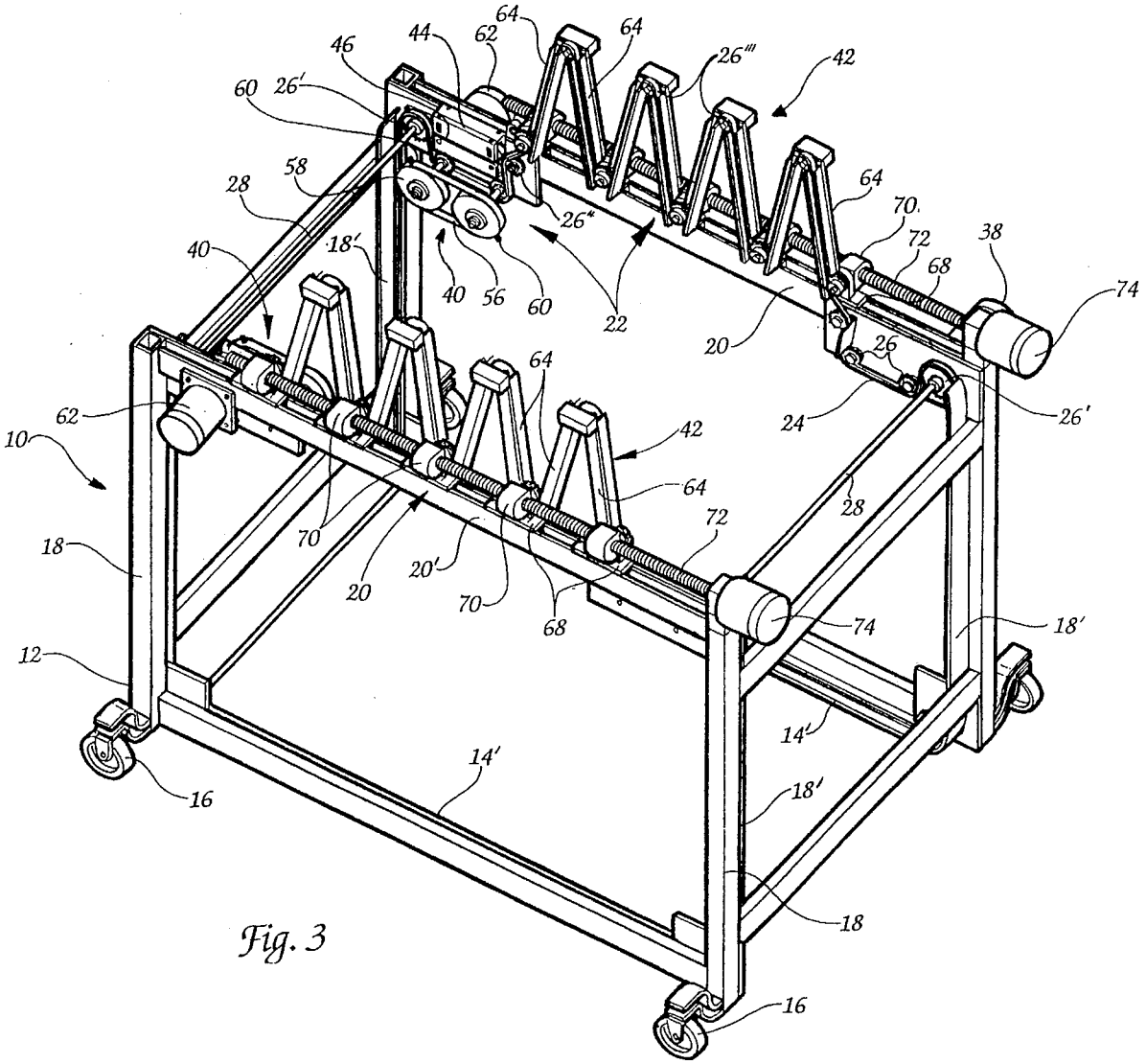
FIG. 3 is a top perspective view of the festooning apparatus of FIGS. 1 and 2, with the traveling fabric and the web supporting elements being removed to reveal the conveyor arrangement of the apparatus.

Referring now to the accompanying drawings and initially to FIGS. 1–3, the web festooning apparatus of the present invention is indicated generally at 10 in a preferred embodiment particularly adapted for accumulating a substantial length of a traveling textile fabric such as may be necessary or desirable to enable a doffing operation to be carried out on a textile fabric-handling machine without interrupting the operation of the machine itself, as more fully described hereinabove.

The festooning apparatus 10 basically includes a floor-standing frame 12 having a rectangular base 14 supported at its four corners on wheeled casters 16 for easy transportability of the apparatus 10, and having upstanding stanchions 18 at the four corners of the base 14 which support at their upper ends a correspondingly rectangular frame superstructure 20.

The frame 12 supports a fabric conveyor arrangement, generally indicated at 22, comprised of a pair of endless chains 24 respectively trained about two corresponding sets of chain sprockets 26 rotatably mounted in identical opposed coaxial facing relation to the opposite longitudinal sides of the frame 12 for travel of the chains 24 in mirror-image parallel facing relation. At each side of the frame 12, four sprockets 26' are situated at the upper and lower corners of the frame 12, with the respective sprockets 26' at the opposite frame sides being rigidly connected coaxially with one another by respective shafts 28 to synchronize traveling movement of the chains 24 and rotational movement of the sprockets 26 at the opposite sides of the frame 12.

Figure 4:
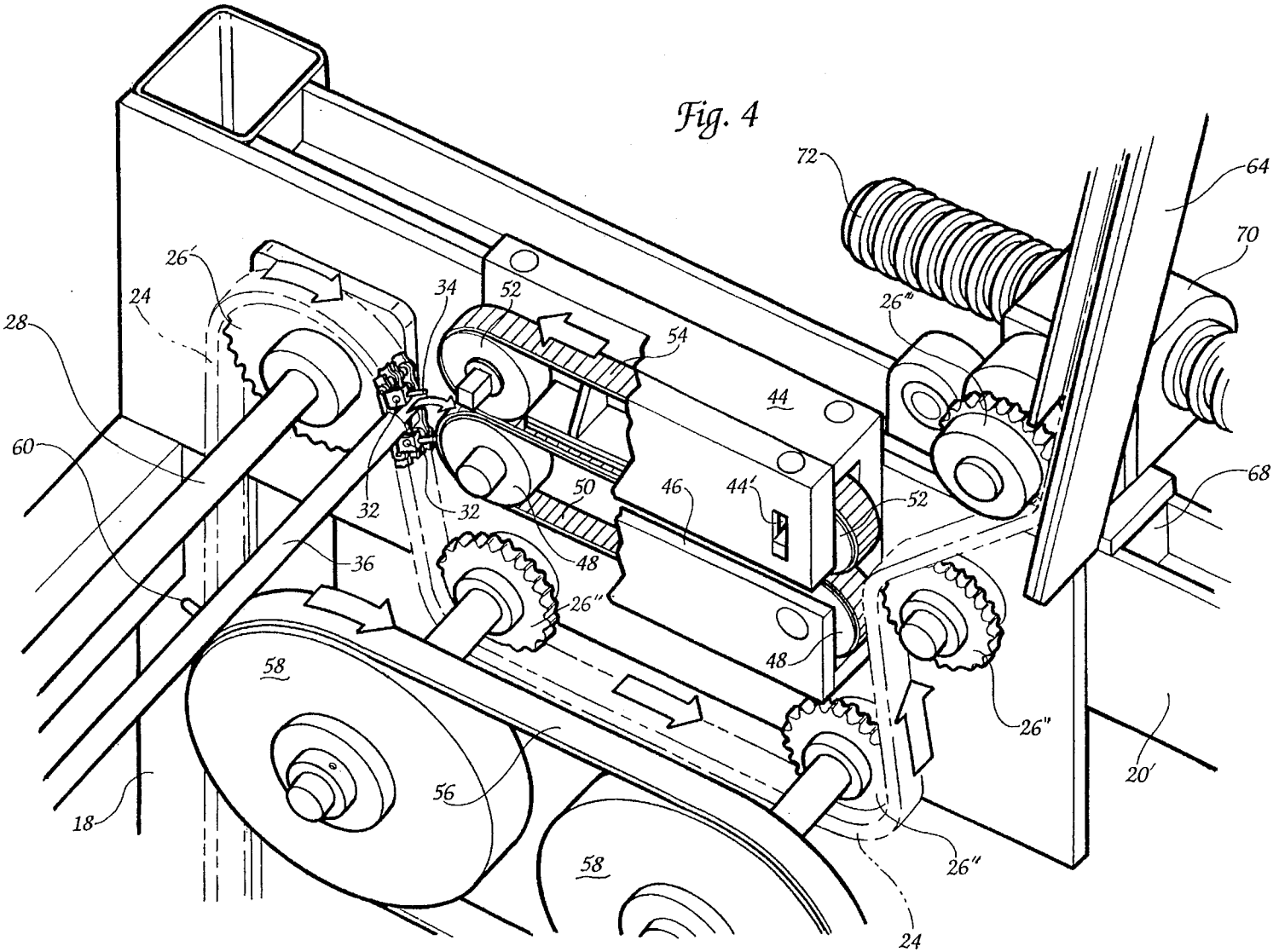
FIG. 4 is a detailed perspective view of the mechanical arrangement disposed at the web receiving end of the frame of the festooning apparatus of FIGS. 1–3, which is operative for temporarily removing and replacing the web supporting elements in succession to form succeeding festoons of incoming fabric.
Figure 5:
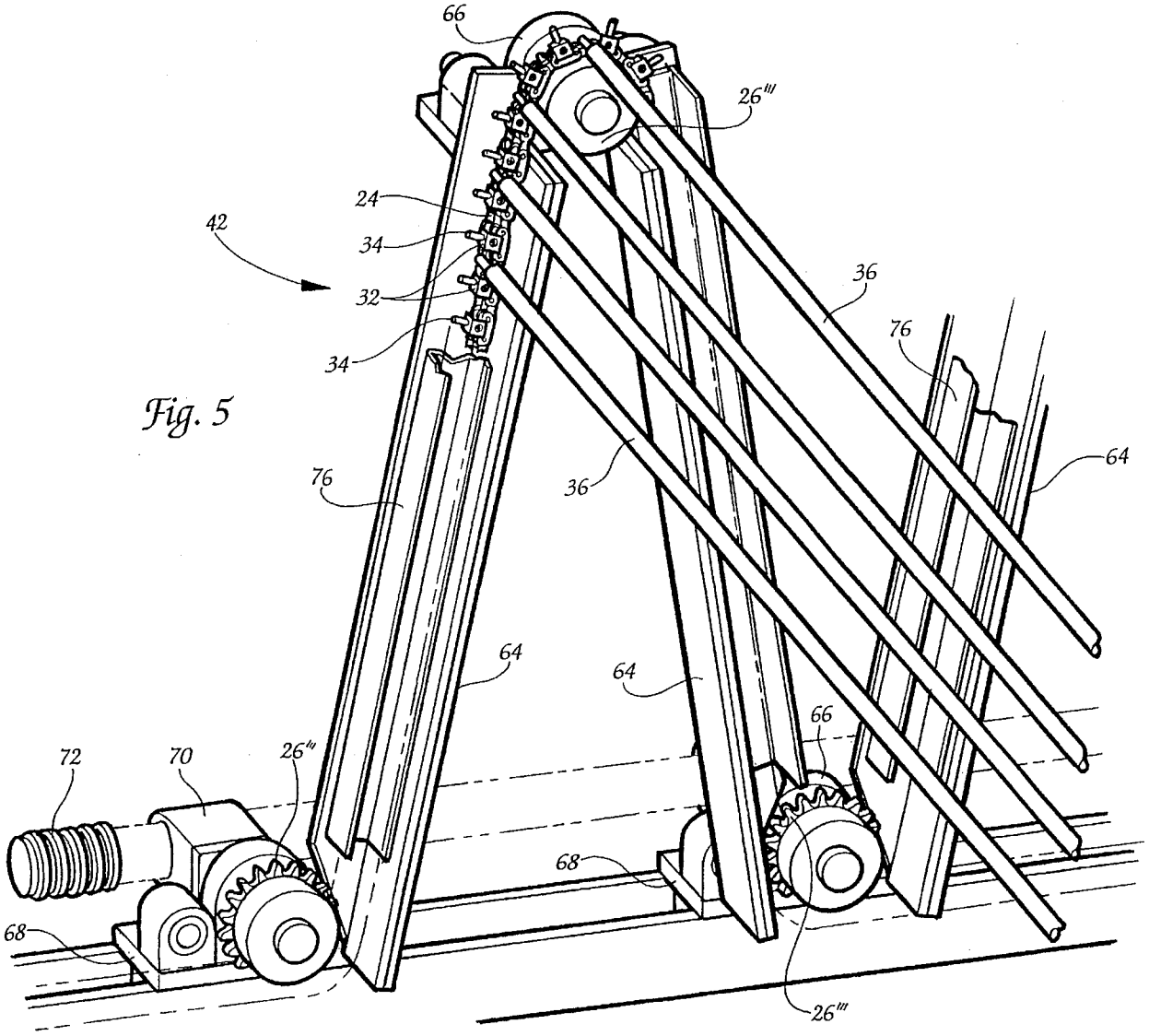
FIG. 5 is a detailed perspective view of the angled conveyor path segments of the upper web carrying run of the conveyor arrangement of the festooning apparatus of FIGS. 1–3.

Each chain 24 carries a series of brackets 32 each carrying an outwardly-extending pin 34 affixed along the inwardly facing side of the chain 24 at equal spacings along its entire length (see FIGS. 4 and 5). A plurality of cylindrical fabric supporting rods 36 extend laterally across the frame 12 with the opposite ends of each rod 36 resting within the channel area intervening successively adjacent brackets 32 on the two conveyor chains 24, whereby the fabric support rods 36 travel successively in parallel relation to one another integrally with the chains 24. Flange portions 14',18' along the base 14 and stanchions 18 of the frame 12 extend outwardly along the vertical end runs and horizontal lower run of the conveyor chains 24 to act as retainers for maintaining the fabric support rods 36 seated in the channels between the brackets 32. Traveling movement of the conveyor arrangement 22 is actuated by a drive motor 38 connected to one of the sprocket shafts 28.

The normal path of travel of a fabric F into and through the festooning apparatus 10 is indicated in FIGS. 1 and 2 by the directional arrow 30. At the fabric entrance end of the frame 12 at which the fabric F is received by the apparatus 10, a festoon forming mechanism, generally indicated at 40, is mounted at each opposite side of the frame 12 to the lengthwise frame members of the superstructure 20 alongside the upper run of the conveyor chains 24 immediately following the upper entrance corner sprockets 26'. As more fully explained hereinafter, the festoon forming mechanism 40 is operative to temporarily remove from the conveyor chains 24 each succeeding fabric supporting rod 36 as it travels with the chain past the adjacent corner sprockets 26' and then to return each fabric support rod 36 in sequence to the conveyor chains 24 after a predetermined dwell time related to the traveling speed of the fabric F so as to form an individual festoon of the fabric F extending downwardly between each successively adjacent pair of the support rods 36.

Immediately following the festoon forming mechanism 40, a festoon compacting mechanism, generally indicated at 42, extends along the upper lengthwise frame members of the superstructure 20 to direct the conveyor chains 24 to travel along the upper run of the conveyor arrangement 22 upwardly and downwardly in a generally sinuous path of travel, which is effective to compact the successive festoons of the fabric F with respect to one another along the lengthwise extent of the frame 12 and, in turn, to increase the overall length of the upper fabric-carrying run of the conveyor arrangement 22 relative to the overall horizontal lengthwise dimension of the frame 12, as more fully explained hereinafter.

Referring now specifically to FIG. 4, the festoon forming mechanism 40 is shown in enlarged detail. As will be seen, at the fabric entrance end of the frame 12, a series of three of the sprockets 26" are arranged as idler sprockets to constrain the conveyor chains 24 at each opposite side of the frame 12 to initially travel along the upper conveyor run downwardly from the adjacent upper corner sprocket 26', then horizontally lengthwise along the frame 12 at a spacing below the upper corner sprocket 26', and then upwardly to the festoon compacting mechanism 42. The festoon forming mechanism 40 is disposed within this region of downwardly diverted travel of the upper run of the conveyor chains 24 to extend horizontally from a point closely adjacent the corner sprocket 26' to a point closely adjacent the last sprocket 26" along the path of chain travel.

The festoon forming mechanism 40 basically comprises a subframe 44 mounted to the lengthwise frame member 20' of the frame superstructure 20 and defining a lengthwise-extending inwardly-opening guide channel 46 dimensioned for passage therethrough of the chain-supported end of each fabric support rod 36 in sequence. Mounted within the subframe 44 beneath the guide channel 46 is a pair of idler pulleys 48 with an endless toothed timing belt 50 trained thereabout and, similarly, a pair of idler pulleys 52 carrying a correspondingly toothed timing belt 54 are mounted within the subframe 44 above the guide channel 46, the axial shafts of the idler pulleys 52 being supported in vertical slots 44' of the subframe 44. In this manner, the upper idler pulleys 52 and their timing belt 54 are movable toward and away from the fixed idler pulleys 48 and timing belt 50 as any fabric support rod 36 passes through the guide channel 46.

The periphery of the first idler pulley 48 is disposed to intersect the path of travel of the fabric support rods 36 immediately adjacent the location at which the conveyor chains 24 leave the corner sprocket 26', so that each fabric support rod 36 in sequence is intercepted by the idler pulley 48 and its timing belt 50 essentially at the nip area between the two timing belts 50,54. Likewise, the second idler pulley 48 is situated with its periphery immediately adjacent the path of travel of the conveyor chain 24 about the last sprocket 26" in the path of chain travel so that each fabric support rod 36 exiting the guide channel 46 between the two timing belts 50,54 is directed immediately onto the conveyor chain 24 for placement immediately between adjacent succeeding pins 34 to seat each support rod 36 in a channel between the pins' respective brackets 32.

The fabric support rods 36 intercepted by the first idler pulley 48 are propelled into and through the guide channel 46 by a secondary endless drive conveyor 56 trained about a pair of drive sprockets 58 rotatably mounted to the upper lengthwise frame member 20' of the frame superstructure 20 beneath the subframe 44 (e.g., coaxially with the first two idler sprockets 26") and laterally inwardly of the path of travel of the conveyor chains 24 so that the upper run of the conveyor 56 extends alongside the line of meshing contact between the two timing belts 50,54 and laterally inwardly of the subframe 44 and the conveyor chains 24. The conveyor 56 is driven by a drive motor (not shown), and the conveyor 56 has one or more pins 60 projecting outwardly from its surface to engage each fabric support rod 36 in sequence at the nip location between the timing belts 50,54 to exert a pushing force thereon for propelling each rod 36 individually through the guide channel 46 of the subframe 44. The driven speed of the secondary conveyor 56 is selected in relation to the traveling speed of the fabric F incoming from the preceding textile fabric-handling operation so that the elapsed dwell time for each fabric support rod 36 between its removal and subsequent replacement on the conveyor chains 24 is sufficient to form a festoon of a predetermined length of the fabric F between the fabric support rod 36 and the immediately preceding rod 36, as more fully described hereinafter.

The festoon compacting mechanism 42 is best seen with reference to FIG. 5 and basically comprises a series of linear chain guide flanges 64 pivotably connected to one another end-to-end by bearing portions 66 affixed coaxially with a chain sprocket 26''' to join the guide flanges 64 in an alternating upwardly and downwardly extending zig-zag orientation. The sprockets 26''' and bearing portions 66 at the free ends of the first and last guide flanges 64 in sequence and at the downwardly intersecting guide flanges 64 therebetween are mounted to respective slide blocks 68, each of which has a threaded drive nut 70 affixed to its outward side. The drive nuts 70 are mounted on an elongate drive screw 72 supported on the upper lengthwise frame member 20' of the frame superstructure 20 and connected to a reversible drive motor 74. In this manner, driven rotation of the screw 72 by the motor 74 selectively in either opposite rotational direction enables the chain guide flanges 64 to be moved in unison toward or away from one another, as desired to establish the angular relationship between the flanges 64. Attached to each chain guide flange 64 is a rod-retaining flange 76 in spaced parallel relation thereto to prevent separation of the fabric support rods 36 from the channel areas between the brackets 32 along the conveyor chains 24 as the chains 24 travel upwardly and downwardly along the guide flanges 64.

The operation of the festooning apparatus 10 may thus be understood. As shown in FIGS. 1 and 2, the festooning apparatus 10 is situated downstream of a textile fabric-handling machine (not shown) to receive the traveling textile fabric F output from the machine over the shaft 28 connecting the upper corner sprockets 26' at the entrance side of the frame 12 facing the upstream textile machine. As each fabric support rod 36 is carried by the conveyor chains 24 upwardly over and then downwardly from the upper corner sprockets 26' at the entrance end of the frame 12, each rod 36 in sequence engages the underside of the fabric F at essentially the same time as it contacts the timing belt 50 about the idler pulley 48 and is deflected and removed from the conveyor chains 24. As the secondary conveyor 56 moves simultaneously about its drive sprockets 58, the next succeeding pin 60 on the conveyor 56 engages the fabric support rod 36 and pushes it through the guide channel 46 between the timing belts 50,54 and, at the opposite end of the guide channel 46, .directs the rod 36 into a receiving channel between the brackets 32 of the conveyor chains 24. During the elapsed dwell time between the removal of the fabric support rod 36 from the conveyor chains 24 and the subsequent replacement of the rod 36 onto the chains 24, the fabric F continues to travel from the upstream textile machine over the support rod 36 to form a festoon of the fabric F between the rod 36 and the immediately preceding rod 36 on the conveyor chains 24.

This operation occurs as each fabric support rod 36 reaches the pulleys and timing belts 48,50,52,54 of the festoon forming mechanism 40, thereby causing succeeding festoons of the fabric F to form between each successive pair of the fabric support rods 36. As previously indicated, the relationship between the traveling speed of the fabric F, the traveling speed of the conveyor chains 24 and the traveling speed of the secondary conveyor 56, along with the number of pins 60 provided on the conveyor 56, collectively determine the length of fabric F forming each festoon.

Subsequent to the replacement of the fabric support rods 36 onto the conveyor chains 24, the chains 24 carry the support rods 36 and the festoons of the fabric F formed therebetween upwardly and downwardly in succession along the chain guide flanges 64 of the festoon compacting mechanism 42, whereby the fabric festoons are caused to form compactly into closely adjacent folds. In this manner, the total overall length of the fabric F accumulated in festoons over the fabric support rods 36 along the upward and downward extents of the chain guide flanges 64 is substantially maximized for the corresponding horizontal lengthwise extent of the apparatus 10 occupied by the chain guide flanges 64. As each fabric support rod 36 in succession travels with the chain 24 from the last chain guide flange 64 in succession and passes over and downwardly beyond the upper corner sprocket 26' at the downstream end of the apparatus frame 12, the fabric F travels over the connecting shaft 28 between the corner sprockets 26' to be directed therefrom to a downstream collection location, not shown.

As will thus be understood, in contrast to conventional festooning apparatus, the apparatus 10 of the present invention provides a substantial level of adjustability by which the capacity of the apparatus 10 to accumulate a lengthwise extent of textile fabric (or any other appropriate web-like material) can be varied and, as necessary, maximized. Specifically, by the selective adjustment of the traveling speed of the conveyor chains 24, the traveling speed of the secondary conveyor 56, the increase or decrease of the number of pins 60 on the secondary conveyor 56, and/or the relative angular inclination of the chain guide flanges 64, the relative spacings between the successive fabric support rods 36 can be varied, the incremental lengthwise extent of each individual festoon of fabric can be varied, and the spacings between the succeeding festoons of the fabric along the chain guide flanges 64 can be varied so that the overall capacity of the festooning apparatus 10 to accumulate a total length of the fabric F can be adjusted to accommodate a wide variety of differing potential applications for the apparatus 10.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for festooning a traveling length of web-like material, comprising:

a frame, conveyor means supported on the frame for movement in an endless path of travel including a web carrying run extending generally laterally across the frame between a web receiving location and a web releasing location, means for driving traveling movement of the conveyor means, a plurality of web support elements removably carried by the conveyor means in succession with one another for supporting an individual festoon of the web depending between each successively adjacent pair of the web support elements, and means generally at the web receiving location for temporarily removing each succeeding web support element from the conveyor means and then replacing each removed web support element onto the conveyor means to control festooning accumulation of the web on the web support elements, the web carrying run comprising a plurality of conveyor path segments extending in succession upwardly and downwardly defining a sinuous path of travel for the conveyor means to increase the length of the web carrying run in relation to the lateral dimension between the web receiving and web releasing locations.

2. Apparatus for festooning a traveling length of web-like material according to claim 1, wherein the conveyor path segments extend angularly to one another.

3. Apparatus for festooning a traveling length of web-like material according to claim 2, wherein the conveyor means comprises means for adjusting the angular relation of the conveyor path segments to one another.

4. Apparatus for festooning a traveling length of web-like material according to claim 1, wherein the conveyor means comprises a pair of endless conveyor members correspondingly arranged in spaced parallel relation at opposite sides of the frame.

5. Apparatus for festooning a traveling length of web-like material according to claim 4, wherein the conveyor means comprises a plurality of guide members correspondingly arranged in spaced parallel relation at opposite sides of the frame, the conveyor members being trained respectively about the guide members.

6. Apparatus for festooning a traveling length of web-like material according to claim 5, wherein each of the conveyor members is an endless chain and each of the guide members is a sprocket, the conveyor means including means for synchronizing movement of the respective chains and sprockets at the opposite sides of the frame.

7. Apparatus for festooning a traveling length of web-like material according to claim 6, wherein each chain includes a series of longitudinally spaced pins for receiving the web support elements therebetween.

8. Apparatus for festooning a traveling length of web-like material according to claim 7, wherein the frame includes retainers disposed stationarily along selected portions of the travel path for maintaining the web support elements between the pins of the chains.

9. Apparatus for festooning a traveling length of web-like material according to claim 1, wherein, at the web receiving location, the conveyor means travels from a web support element releasing position to a web support element replacement position, and the web support element removing and replacing means comprises secondary conveyor means for receiving the web support elements from the conveyor means at the releasing position and transporting the elements to the replacement position in a predetermined timed relation to the traveling movement of the conveyor means for causing a festoon of a predetermined length of the web to form between succeeding web support elements.

10. Apparatus for festooning a traveling length of web-like material according to claim 9, wherein the secondary conveyor means comprises web support element guide means extending between the releasing and replacement positions and an endless conveyor belt having at least one transfer pin for periodically engaging and transporting the web support elements sequentially through the guide means.

11. Apparatus for festooning a traveling length of web-like material, comprising:

a frame, conveyor means supported on the frame for movement in an endless path of travel including a web carrying run extending generally laterally across the frame between a web receiving location and a web releasing location, means for driving traveling movement of the conveyor means, and a plurality of web support elements carried by the conveyor means in succession with one another for supporting an individual festoon of the web depending between each successively adjacent pair of the web support elements, the web carrying run comprising a plurality of conveyor path segments extending in succession upwardly and downwardly defining a sinuous path of travel for the conveyor means to increase the length of the web carrying run in relation to the lateral dimension between the web receiving and web releasing locations.

12. Apparatus for festooning a traveling length of web-like material according to claim 11, wherein the conveyor path segments extend angularly to one another.

13. Apparatus for festooning a traveling length of web-like material according to claim 12, wherein the conveyor means comprises means for adjustably varying the angular relation of the conveyor path segments to one another.

* * * * *